United States Patent [19]

Cukier

[11] 4,395,326

[45] Jul. 26, 1983

[54] TREATMENT OF COAL TAR EMULSIONS

[76] Inventor: Samuel Cukier, 27 Newgate Rd., Toronto, Ontario, Canada, M6B 3G5

[21] Appl. No.: 342,210

[22] Filed: Jan. 25, 1982

Related U.S. Application Data

[63] Continuation-in-part of Ser. No. 202,363, Oct. 29, 1980, abandoned.

[51] Int. Cl.[3] ..... C10G 33/04

[52] U.S. Cl. ..... 208/188; 208/39

[58] Field of Search ..... 208/44, 45, 188, 39; 252/329, 332, 358

[56] References Cited

U.S. PATENT DOCUMENTS 2,956,944 10/1960 Logan ..... 208/39

FOREIGN PATENT DOCUMENTS 583998 1/1947 United Kingdom ..... 208/39
352929 10/1972 U.S.S.R. ..... 208/188
410074 4/1974 U.S.S.R. ..... 208/188

OTHER PUBLICATIONS

Weil et al, *Journal of the American Oil Chemists Society,* vol. 36, (1959), pp. 241–244.

Kirk-Othmer, *Encyclopedia of Chemical Technology,* 2nd Ed., Interscience, N.Y., (1969), vol. 19, pp. 528, 529.

Patzek, *Chemical Abstracts,* vol. 70, (1969), No. 108114z.

Medvedev et al, *Chemical Abstracts,* vol. 78, (1973), No. 100291z.

*Primary Examiner*—Brian E. Hearn

[57] ABSTRACT

The present invention relates to a process for the treatment of stable emulsions of water and quinoline insolubles in coal tar comprising thoroughly mixing the coal tar with at least one of a specific class of surface-active compositions, followed by a separation of water and quinoline insoluble components from the mixture. The invention also relates to a method of eliminating or minimizing the build-up of coal tar-derived deposits on surfaces in contact with the coal tar.

12 Claims, No Drawings

TREATMENT OF COAL TAR EMULSIONS

This is a continuation-in-part of U.S. patent application Ser. No. 202,363, filed Oct. 29, 1980, now abandoned.

FIELD OF THE INVENTION

The present invention relates to bituminous material. More particularly, it relates to a method for modifying coal tar material.

BACKGROUND OF THE INVENTION/PRIOR ART

The water content of coal tars is one of its more variable and troublesome characteristics. Associated with this water content are ammonium compounds, in particular ammonium chloride, to which much of the equipment corrosion during tar distillation can be attributed. While the addition of alkali to the tar will reduce the corrosion, the usually non-volatile alkali compound remains in the pitch residue following distillation, often affecting its properties adversely.

Attempts have been made, with varying degrees of success to eliminate or diminish the water content of the tar. The less successful ones have included addition of electrolyte, modification of the tar pH, freezing of the tar, and subjecting the tar to high frequency mechanical agitation. Among the more successful processes has been boiling the tar. Nonetheless such a procedure is rather energy intensive and generally fails to achieve an adequate reduction in the water content of the tar.

Another problem that has plagued the users of tar is the often high (and also variable) content of quinoline insolubles (Q.I.) therein. The problem is particularly noticeable when these insolubles are concentrated in the pitch residue following the distillation of the tar. The particulate nature of Q.I. renders difficult virtually any process which requires the passage of the pitch through small orifices, e.g. in the impregnation of porous, baked carbon bodies. Additionally, should the Q.I. have a high inorganic portion, the combustion rate of the carbon body produced by coking (or otherwise carbonizing) the pitch will be significantly increased. It is believed that the water and Q.I. are associated with each other to form the disperse phase of a stable emulsion in the coal tar material which is difficult to break by conventional means.

The stability of such emulsions has presented a hitherto intractable problem to the person attempting a separation. An earlier attempt (described in "Use of Surface Active Agents For Improving Separation of Tar-Water Emulsions" - Tadeusz Patzek - Koks, Smola, Gaz 1968, 13 (11), (330), at such a separation describes the results as follows: "In the case of coal tar-water emulsions that sep. well on standing, all chemicals accelerated the phase sepn, and improved the dewatering of the tar. In the case of stable emulsions, however, none of the prepns. was effective in sepg. the phases even when the emulsions were heated and allowed to stand for up to 120 hrs. There was no sepn. on the tar phase contained 20–30 % or more $H_2O$. In some cases, it appeared that the surfactant added as an emulsifier, causing added stabilization of the emulsions." (from Chemical Abstracts, Vol. 70 (1969) no. 108114Z).

Another problem often encountered during the handling or transport of coal-tar material is the adhesion and/or deposition of coal-tar components on surfaces contacting the coal-tar material.

Accordingly, it is an object of this invention to provide an improved process for the dewatering of tars.

It is also another object of this invention to decrease the quinoline insoluble content in the tar.

It is yet another object of the present invention to provide a means whereby the afore mentioned adhesion and tar deposition of coal-tar material components on contacting surfaces is minimized.

BRIEF DESCRIPTION OF THE INVENTION

The process for treating a stable emulsion of coal tar material containing water and quinoline insolubles, comprising: mixing a surface active composition with said material so as to facilitate the segregation of at least a portion of at least one of said water and said quinoline insolubles from said tar where said surface active composition contains as the active ingredient, a member chosen from the group comprising the class of compounds having the general formula $CH_3(CH_2)_xCH_2(OCH_2CH_2)_yOSO_3^-M^+$, where the average value of x lies in the range 6.5 to 13, y is at least 1.5, and $M^+$ represents one of sodium and ammonium ions.

DETAILED DESCRIPTION OF THE INVENTION

Accordingly, the present invention relates to a process whereby a stable emulsion of a bituminous material, in particular coal tar, can be treated in order to decrease the amount of water and quinoline insolubles contained therein. Broadly stated, this process will comprise the steps of thoroughly mixing the tar with a surface-active composition defined below, so as to facilitate the segregation of at least one of the water and the quinoline insolubles from the mixture, which can be subsequently separated from the mixtures. The surface-active composition used herein will comprise a member chosen from the class of compounds having the general formula $CH_3(CH_2)_xCH_2(OCH_2CH_2)_yOSO_3^-M^+$; where the average value of x lies in the range 6.5 to 13, y is at least 1.5 and $M^+$ represents one of sodium and ammonium ions. Clearly individual values of x can lie within or outside these bounds. For example, a particularly efficacious composition for use herein is the ethoxylated sulfate prepared from the $C_{13}$ alcohol, i.e. $x=11$ in the above terminology. The ethylene oxide portion will usually constitute about 40% of the molecular weight, which will correspond to y taking on values in the range 1.5 to 6. The amount of surface-active composition which will be employed will usually range from about 0.001 to 1% of the coal tar material, although quantities which fall outside these limits may also be used, depending on the material being treated and the end-result sought. The surfactant for use in the above-noted separation of water and Q.I. from coal tar, can be either derived from an ethylene condensation process, in which case the alkyl group is straight chain, or alternatively it can be derived from a propylene condensation process in which case the alkyl group will have a branched chain.

Procedurally, the present invention will comprise mixing the surface-active composition with the tar at a temperature where the tar is in a relatively fluid state, in any event stirrable or pumpable (typically about 70°–90° C.). For example, the surface-active composition may be bled in while the tar is being pumped into a storage tank, thus uniformly distributing the additive throughout the tar while obviating the need for any special mixing equipment.

The mixture is maintained at the stirrable temperature while the ensuing separation is carried out. It should be noted, however, that an increase in temperature can improve the separation, but may lead to some modification of the constituents of the tar. The separation may be carried out, for example, merely by leaving the mixture in a quiescent state while permitting the water and solids to separate as the top and bottom strata of the mixture, which may be subsequently separated from the tar by means of decantation or the like. Alternatively, an improved separation can be obtained if techniques such as centrifugation of the mixture are employed. The separation technique employed will, in part, determine the degree to which water and quinoline insolubles will be separated from the tar.

This process can alternatively be recast into a cyclic system where a portion of the separated water is bled off and fresh surfactant added thereto, to replenish its concentration before being returned to the treatment step.

While it is not entirely clear how the addition of the surface-active composition can cause a separation of both the quinoline insoluble and the water from the tar; it is believed that the water and the quinoline insoluble content of the untreated material are somehow associated with each other so as to form a disperse phase having an apparent density which is substantially the same as that of the tar. The addition of the surface-active agent causes these components of the disperse phase to dissociate and rise or sink in the body of tar according to their respective specific gravities relative to tar. A desirable attribute of the present process is the substantial absence of residual surface-active agent in the tar following the separation of the tar from the water, since the surface-active agent will be associated with and removed with the water. A portion of this separated liquid containing the surface active agent can be recycled and reused in further separations after the concentration of the surface active agent therein has been replenished. This procedure has the advantage of eliminating or minimizing the adhesion to and deposition on the surfaces in contact with the coal tar, such as pumps, pipes, storage tanks, etc. In addition to the removal of the water and Q.I. from the tar, the present invention generally removes salts, electrolytic material and other inorganics associated with the Q.I. and the water which might result in an increased corrosion during processing and an increased oxidation rate of the coke formed therefrom. However the actual mechanism whereby the addition of the surface-active agent affects the quinoline insolubles, water and/or the tar itself may be quite different from the hypothetical one outlined above and accordingly we would not wish to be restricted thereto.

The following examples will serve to illustrate some embodiments of the present invention.

EXAMPLE 1

The heavy tar (having a stable disperse phase of water therein) which was to be subjected to the process of the present invention was first mixed with an ethoxylated sulfated ester salt of fatty alcohols having an average chain length of 13 carbon atoms (in the above terminology, where $x=11$), and an average value of $y=2.2$, approximately. The mixing of tar with the surface active agent was carried out at about 80°-90° C. following which 2 samples of the tar mixture containing 0.1% by weight of this surface active agent were allowed to stand in ovens at temperatures of about 75° and 90° C., respectively for about 24 hours, thus simulating the conditions of relative quiescence and temperature prevailing in a tar storage tank. The water which separated at the surface was decanted off and measured while the residual water content of the tar was also measured. The results, which indicate the proportions of the water separated by decantation and the water residual in the tar are indicated in Table I below. The small discrepancies in the total water contents before and after treatment are insignificant.

A water reducing agent for tars, commonly used in the industry, and which comprises a polypropylene oxide-type surfactant sold under the trademark "Tretolite" was added to the tar in proportions which constituted 0.2% by weight of the resultant mixture. This mixture was divided into 2 portions and subjected to the same treatment as described above. The residual water content of the tar were measured and was found substantially unchanged. These results which are summarized in Table I below, indicate that recourse to the present invention results in a better separation of the water from tar. These results also serve to indicate the degree of stability of such coal tar emulsions. Tretolite (TM) does not cause any noticeable stratification of the emulsion, 24 hours after its addition to the coal tar.

In a similar experiment, tar having an augmented water content (about 18.4% by weight of the tar-water mixture) was prepared and two samples from this mixture were treated with about 0.1% by weight of the present invention surface-active agent, and 0.2% by weight Tretolite (TM). The samples were placed in an oven set at 90° C. Following 24 hours of this treatment, the separated and residual water contents of the tar were determined for each of the samples, and are summarized in Table I below. As before, notwithstanding the smaller amounts of surface active agent employed, the present invention results in better water removal from the tar.

TABLE I

| | | Present Invention Surface-Active Agent | | 0.2% Tretolite (TM) | |
|---|---|---|---|---|---|
| | Tar as Received (%) Water | Water Decanted after 24 hr. (%) | Water Remaining after 24 hr. (%) | Water Decanted after 24 hr. (%) | Water Remaining after 24 hr. (%) |
| Tar Sample | 9.0 | | | | |
| 24 hrs. at 75° C. | | 2.2 | 6.4 | Nil | 8.5 |
| 24 hrs. at 90° C. | | 5.0 | 3.5 | Nil | 8.0 |
| Tar Sample + 10% Water mixed in | 18.4 | | | | |
| After 24 hrs. at 90° C. | | 13.5 | 4.0 | 5.0 | 12.5 |

EXAMPLE 2

While the present invention can be successfully employed with tars having a high Q.I. content, it can also be applied to tars having a relatively low Q.I., as this example demonstrates.

Accordingly, tar samples having a Q.I. content of 7.3% and containing 0.1% by weight of the same surface-active agent employed in the preceding example were prepared. Equal proportions of untreated and treated tar were spun at a high speed (about 1000 r.p.m.) on a clinical centrifuge for 5 minutes at 70°, 80° and 90° C. The Q.I. of the overflow fraction of the centrifuged material was measured, and is summarized in Table II below. It will be evident upon an examination of the table that the decrease in the Q.I. ranges from between about 20–25%, and the overflow fraction from the higher temperature centrifugation could be used in the preparation of an impregnating pitch.

TABLE II

| | Centrifugation Temperature | | |
|---|---|---|---|
| | 90° C. | 80° C. | 70° C. |
| | % Q.I. in the overflow fraction | | |
| Untreated Tar | 4.1 | 4.3 | 4.6 |
| Treated Tar | 3.1 | 3.3 | 3.6 |

The overflow (of about 85%) from the two samples of tar (i.e. untreated and treated) which had been centrifuged at 90° C., were subjected to filtration carried out at 90° C. and under a nitrogen pressure of 75 p.s.i.g. The proportion of the tar sample that passed through the filter in the first minute was about 54% in the case of the untreated tar and 62% in the case of the treated tar. The reason for the easier filtration of the treated tar include the presence of a smaller amount of solids, and a lower tar viscosity due to the treatment.

EXAMPLE 3

This example illustrates how the addition of the surface-active agent of the present invention to the tar and allowing the tar to stand as described in the present invention can result in a marked stratification of some of the components therein, e.g. the Q.I., free carbon and water and comparing their concentrations in the untreated tar which is homogeneous due to the stability of the water-Q.I. disperse phase in the coal tar material.

0.1% of surface-active agent was mixed with the tar at 85° C., samples taken from the middle and bottom strata and tested for their Q.I., free carbon and water contents, after the tar had been allowed to stand for about 4.5 hours. This procedure was repeated after a standing time of 28 hours. The results of these tests as well as values of Q.I., free carbon and the water content in the untreated tar are summarized in Table III below.

The entries in the table below demonstrate how the treatment serves to increase the free carbon and the Q.I. content of the bottom layers while reducing the water content therein from 17.3 to 2%. Obviously, the decrease in the water content of the lower strata will be balanced by an equivalent increase in the upper strata from which it can easily be removed.

TABLE III

| | | Untreated Tar (%) | Middle Stratum (%) | Bottom Stratum (%) |
|---|---|---|---|---|
| Quinoline Insoluble | 0 hrs | 14.3 | 14.3 | 14.3 |
| | 4.5 hrs | 14.3 | 14.8 | 15.9 |
| | 28 hrs | 14.3 | 16.0 | 16.1 |
| Free Carbon | 0 hrs | 20.8 | 20.8 | 20.8 |
| | 4.5 hrs | 20.8 | 23.1 | 24.6 |
| | 28 hrs | 20.8 | 22.7 | 24.8 |
| Water | 0 hrs | 17.3 | 17.3 | 17.3 |
| | 4.5 hrs | 17.3 | 3.0 | 3.0 |
| | 28 hrs | 17.3 | 2.0 | 2.0 |

EXAMPLE 4

This example illustrates the substantial equivalence of the branched chain and straight chain surface active agents in the present invention.

0.05 g of surfactant being tested were stirred into 50 g of tar containing 18% by weight of water at 85° C. and poured into centrifuge tubes and allowed to stand overnight before being centrifuged for 1 minute. The table below summarises the experimental results which indicate the substantial equivalence of the linear surface-active agent (as exemplified by Cedepal SS-406) and the branched chain surface active agent (as exemplified by Cedepal TD-407) as the tar dewatering agents.

TABLE IV

| Surfactant Name (TM) (TYPE) | Average Value of x* | % Water in Tar after Treatment |
|---|---|---|
| Cedepal SS-406 (Linear) | 10 | 7 |
| Cedepal TD-407 (Branched) | 11 | 5 |

*Where (x + 2) represents the number of carbon atoms in the alkyl group.

The description and examples provided above are for the purpose of providing a complete disclosure of the invention, and alterations and modifications within the scope of the amended claims, may occur to those skilled in the art.

I claim:

1. A process for treating a stable emulsion of coal tar material containing water and quinoline insolubles, comprising mixing a surface active composition with said material, so as to facilitate the segregation of at least a portion of at least one of said water and said quinoline insolubles from said mixture, where said surface active composition is chosen from the class of compounds having the general formula $CH_3(CH_2)_xCH_2(OCH_2CH_2)_yOSO_3^-M^+$ where the average value of x is in the range 6.5 to 13, y is at least 1.5, and $M^+$ represents one of sodium and ammonium ions.

2. A process as defined in claim 1, wherein said segregated portion of at least one of said water and said quinoline insolubles is separated from said mixture.

3. A process as defined in claim 1, wherein y is at most 6.

4. A process as defined in claim 1, wherein the average value of x is about 10.

5. A process as defined in claim 2 wherein said separation is carried out by decantation of said mixture.

6. A process as defined in claim 2 wherein said separation is carried out by centrifugation of said mixture.

7. A process as defined in claim 2, 3 or 4 wherein said separation is carried out at a temperature greater than 70° C.

8. A process as defined in claim 2, 3 or 4 wherein said surface-active composition is added to said coal-tar material in an amount which constitutes between 0.001 and 1% of said coal-tar material.

9. A process as defined in claim 1, wherein the adhesion of constituents of said coal tar material to contacting surfaces is significantly reduced.

10. A process as defined in claim 1 or 3, wherein said surface-active composition comprises compounds having branched chain alkyl groups.

11. A process as defined in claim 1 or 3, wherein said surface-active composition comprises compounds having straight chain alkyl groups.

12. A process as defined in claim 3, wherein the average value of x is about 10.

* * * * *